US005446252A

United States Patent [19]

Burger

[11] Patent Number: 5,446,252

[45] Date of Patent: Aug. 29, 1995

[54] FLAT SPRING ACTUATING MECHANISM FOR PLUNGER-TYPE SWITCH

[76] Inventor: Philip M. Burger, 21002 Bittersweet Dr., Lenexa, Kans. 66220

[21] Appl. No.: 184,960

[22] Filed: Jan. 21, 1994

[51] Int. Cl.[6] ..... H01H 3/00

[52] U.S. Cl. ..... 200/329; 200/331; 200/341; 200/18; 200/520; 200/573; 200/276

[58] Field of Search ..... 200/329, 330, 331, 341, 200/573, 520, 537, 18, 460, 276, 276.1, 574, 47

[56] References Cited

U.S. PATENT DOCUMENTS

| | | | |
|---|---|---|---|
| 2,673,468 | 3/1954 | Immel et al. | 74/99 |
| 2,679,559 | 5/1954 | Morris et al. | 200/47 |
| 2,888,731 | 6/1959 | McElroy et al. . | |
| 3,094,591 | 6/1963 | Hill | 200/330 X |
| 3,099,736 | 7/1963 | Willcox | 200/330 |
| 3,566,065 | 2/1971 | Davis | 200/330 |
| 3,594,529 | 7/1971 | Cartwright | 200/330 |
| 3,647,309 | 3/1972 | Thompson . | |
| 3,825,809 | 7/1974 | Gatland . | |
| 3,836,300 | 9/1974 | Farrell . | |
| 4,295,017 | 10/1981 | Kashima et al. | 200/47 |
| 4,307,271 | 12/1981 | Carli | 200/47 |
| 4,488,024 | 12/1984 | Colgate | 200/330 |
| 4,619,271 | 10/1986 | Burger et al. | 200/573 X |
| 5,168,982 | 12/1992 | Hakanen | 200/330 X |

FOREIGN PATENT DOCUMENTS

| | | | |
|---|---|---|---|
| 829965 | 3/1960 | United Kingdom | 200/276.1 |
| 1594621 | 9/1990 | U.S.S.R. . | |

*Primary Examiner*—Ernest G. Cusick
*Attorney, Agent, or Firm*—Litman, McMahon & Brown

[57] ABSTRACT

An actuating mechanism for a plunger-type switch having alternative open and closed conditions and having a plunger movable between an extended position and a retracted position whereby said switch condition is changed by the movement of said plunger comprises a flat spring, having a first spring end, a second spring end and a middle portion, and a housing having an upper surface wherein the plunger-type switch and spring are positioned within the housing such that the first spring end is positioned in closely spaced relation to the plunger in the extended position and the middle portion of the spring bows above the housing upper surface such that application of a force to the middle portion of the spring and directed towards the housing upper surface compresses the spring advancing the spring first end toward the switch a distance sufficient to move the plunger to the retracted position and upon removal of the force the first spring end advances away from the switch a distance sufficient to allow the plunger to move to the extended position.

12 Claims, 1 Drawing Sheet

FLAT SPRING ACTUATING MECHANISM FOR PLUNGER-TYPE SWITCH

BACKGROUND OF THE INVENTION

The present invention relates to a limit switch actuating mechanism for a plunger-type switch, and more specifically such an actuating mechanism which uses a flat spring to actuate the plunger-type switch.

Plunger-type switches having relatively small dimensions such as the B3-32131 sub sub miniature basic switch manufactured by Otto Engineering, Inc. are readily available and relatively inexpensive. In addition numerous actuating mechanisms for limit switch applications have been developed for such plunger-type switches. However these actuating mechanisms are often complex involving numerous parts and complicated construction. There remains a need for relatively simple, durable and reliable actuating mechanisms for plunger-type switches which enable use of the switch as a limit switch or proximity sensor and which enable placement of the switch and actuating mechanism in relatively narrow spaces.

The length of a plunger-type switch (the dimension of the switch extending along the axis of the plunger) is generally considerably greater than the thickness of the plunger-type switch. Therefore, to ensure minimum thickness of the limit switch, the actuating mechanism should translate a force applied perpendicular to the axis of the plunger to a force directed coaxially with the plunger.

SUMMARY OF THE INVENTION

The present invention comprises an actuating mechanism for a plunger-type switch having alternative open and closed conditions and having a plunger moveable between an extended position and a retracted position whereby the switch condition is changed. In some switches, the switch may be open when the plunger is in the extended position and closed when the plunger is in the retracted position, and in other switches, the switch may be closed with the plunger in the extended position and open with the plunger in the retracted position.

The actuating mechanism generally comprises a flat spring, having a first spring end and a second spring end, which is secured within a housing along with the plunger-type switch such that the first spring end is spaced in close proximity to or in engagement with the plunger in the extended position. A middle or bowed portion of the flat spring extends above an upper surface of the housing through an opening or slot. The second spring end abuts against the housing at an end of the opening or slot opposite the first spring end. Application of an external force to the middle or bowed portion of the spring directed towards the upper surface of the housing changes the position of the plunger and more specifically advances the first spring end toward the switch a distance sufficient to move the plunger to the retracted position. Upon removal of the external force, the flat spring returns to its original state such that the first end of the flat spring advances away from the switch and the plunger is allowed to move to the extended position.

OBJECTS AND ADVANTAGES OF THE INVENTION

Therefore it is an object of this invention to provide a limit switch actuating mechanism for a plunger-type switch having alternative open and closed conditions and having a plunger moveable between an extended position and a retracted position whereby the switch condition is changed, to provide such an actuating mechanism which enables placement of the switch and actuating mechanism in relatively narrow spaces, to provide such an actuating mechanism which translates a force applied perpendicularly to the axis of the plunger to a force directed coaxially with the plunger to advance the plunger between the extended and retracted positions, to provide such an actuating mechanism which advances the plunger to the retracted position upon application of a force to the actuating mechanism, to provide such an actuating mechanism which allows the plunger to automatically return to the extended position upon removal of the force applied to the actuating mechanism, to provide such an actuating mechanism which is reliable, durable, relatively simple and inexpensive to manufacture and particularly well adapted for its intended use.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE PREFERRED EMBODIMENT

As required, detailed embodiments of the present invention are disclosed herein; however, it is to be understood that the disclosed embodiments are merely exemplary of the invention, which may be embodied in various forms. Therefore specific structural and functional details disclosed herein are not to be interpreted as limiting, but merely as a basis for the claims and as a representative basis for teaching one skilled in the art to variously employ the present invention in virtually any appropriately detailed structure.

Figure 1:
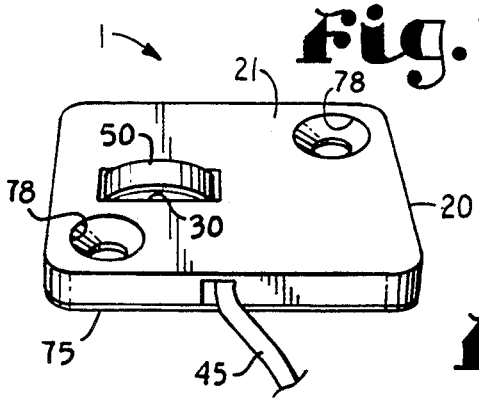
FIG. 1 is a perspective view of a limit switch actuating mechanism for a plunger-type switch.
Figure 2:
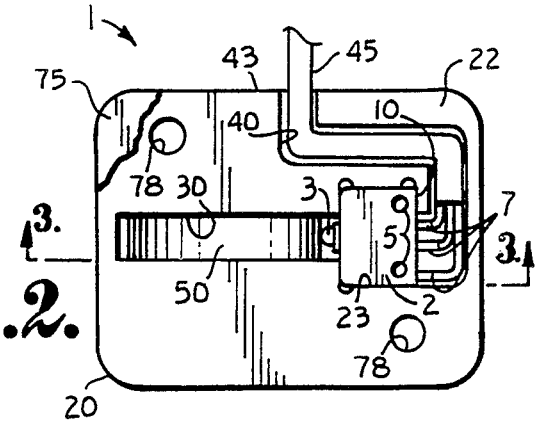
FIG. 2 is a bottom plan view of the limit switch actuating mechanism with portions broken away to show detail thereof.

Referring to the drawings in more detail, the reference numeral 1 refers to an actuating mechanism for a plunger-type switch 2. The switch 2, as best seen in FIG. 2, is a plunger actuated type having a plunger 3 projecting from a switch casing 4 such as the B3-32131 switch discussed above. The switch 2 operates with a snap action upon axial movement of the plunger 3 through a given distance between an extended position to a retracted position. The plunger 3 is normally biased to the extended position. Securement holes 5 extend through the switch casing 4 to facilitate securement of the switch to a selected structure. Three terminals 7 extend rearward from an end 10 of the switch opposite the plunger 3.

Figure 3:
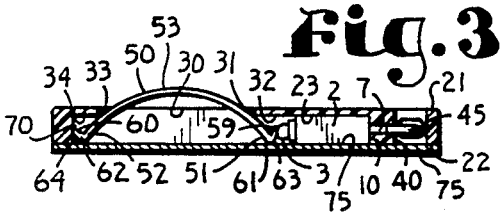
FIG. 3 is a cross-sectional view generally taken along line 3—3 of FIG. 2.
Figure 4:
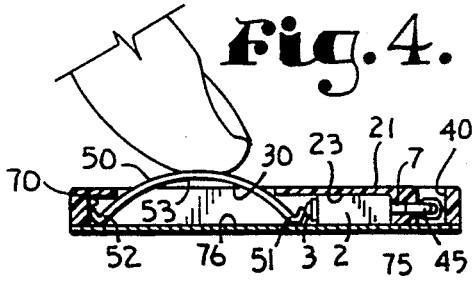
FIG. 4 is a view similar to FIG. 3 showing the application of a force on a flat spring of the actuating mechanism to activate the plunger-type switch.

The actuating mechanism 1 includes housing means such as housing 20 for securing the switch 2 therein. The housing 20 is preferably formed from a relatively hard, rigid material such as a hard plastic. The housing 20 includes an upper surface 21 and a lower surface 22. As is best seen in FIGS. 3 and 4, the distance between the upper surface 21 and the lower surface 22 of the housing 20 is preferably only slightly greater than the thickness of the switch 2. A switch receiving cavity 23 is formed in the housing 20 and extends from the lower surface 22 toward the upper surface 21 thereof. The switch 2 is securable within the switch receiving cavity 23 such that the axis of the plunger 3 extends in parallel r! elation with the upper and lower surfaces 21 and 22 of the switch 2.

A spring receiving opening or slot 30 extends through the housing 20 from the upper Surface 21 to the lower surface 22. A first end 31 of the slot 30 opens into the switch receiving cavity 23 such that the plunger 3 extends into the slot 30. In addition, the slot 30, near its first end 31 does not extend completely through the housing 20 such that a portion of the housing 20 extends over the slot 30 at the slot first end 31 to form a first overhang 32. Similarly, the slot 30, near a second end 33 thereof, does no extend completely through the housing 20 such that a portion of the housing 20 extends over the slot 30 at the slot second end 33 to form a second overhang 34. The slot 30 is preferably rectangular and extends coaxially with the axis of the plunger 3.

A channel 40 is also formed in the housing 20 so as to extend from the lower surface 22 and toward but not completely to the upper surface 21 of the housing 20. A first end of the channel 40 opens into the switch receiving cavity 23 at an end of the cavity 23 at which the terminals 7 are positioned. The channel 40, at a second end thereof, extends out a side 43 of the housing 20. Electrical wiring 45 is securable to the terminals 7 and extendable through the channel 40. The side of the housing 20 to which the electrical wiring 45 needs to be routed may vary depending on the particular application sought and therefore the routing of the channel 40 may vary.

A flat spring 50 preferably formed from spring steel is secured within the slot 30. The flat spring 50 includes a first spring end 51, a second spring end 52 and a middle portion 53. In its resting state, the spring 50 is bowed. The first spring end 51 and the second spring end 52 are bent upward in the direction of the bow in the spring 50 to form form a first foot 59 and a second foot 60 respectively comprising first and second rounded edges or elbows 61 and 62 respectively and first and second plunger engaging surfaces 63 and 64 respectively.

The spring 50 is positioned within the slot 30 of the housing 20 in the resting state and such that the middle portion 53 of the spring 50 extends through the slot 30 and bows above the upper surface 21 of the housing 20. The spring 50 is sized such that when it is positioned in the slot 30 the first plunger engaging surface 63 of the first spring end 51 is positioned in closely spaced relation to the end of the plunger 3 positioned in the extended position and the second plunger engaging surface 64 of the second spring end 52 is positioned in closely spaced relation to an inner wall 70 of the housing 20 at the slot second end 33. The phrase "in closely spaced relation" is intended to mean in actual engagement or positioned slightly apart. In addition, when the spring 50 is positioned within the slot 30, the first spring end 51 is generally positioned beneath the first overhang 32 and the second spring end 52 is generally positioned beneath the second overhang 34.

A backing 75, formed from a layer of relatively thin material, is secured to the lower surface 22 of the housing by means such as an adhesive. The backing 75 extends across the switch receiving cavity 23, the spring receiving slot 30 and the channel 40 and secures the switch 2, the spring 50 and the electrical wiring 45 respectively therein. The first and second rounded edges 60 and 61 of the spring 50 engage an inner surface 76 of the backing 75.

As is best seen in FIG. 4, application of a force to the middle portion 53 of the spring 50 and toward the upper surface 21 of the housing 20 compresses the spring 50 such that the first spring end 51 advances further away from the second spring end 52 and toward the switch 2 a distance sufficient to drive or move the plunger 3 to the retracted position. Removal of the force applied to the middle portion 53 of the spring 50 allows the spring 50 to return to the resting state such that the first spring end 51 advances away from the switch a distance sufficient to allow the plunger 3 to advance back to the extended position. The spring 50 thereby translates a force applied perpendicularly to the axis of the plunger 3, to a force applied coaxially with the plunger 3.

The limit switch actuating mechanism 1 is securable to various structures by securement means such as adhesives or bolting. The housing 20 includes countersink bores 78 through which screws or bolts may be driven for securing the housing 20 to a structure.

Figure 6:
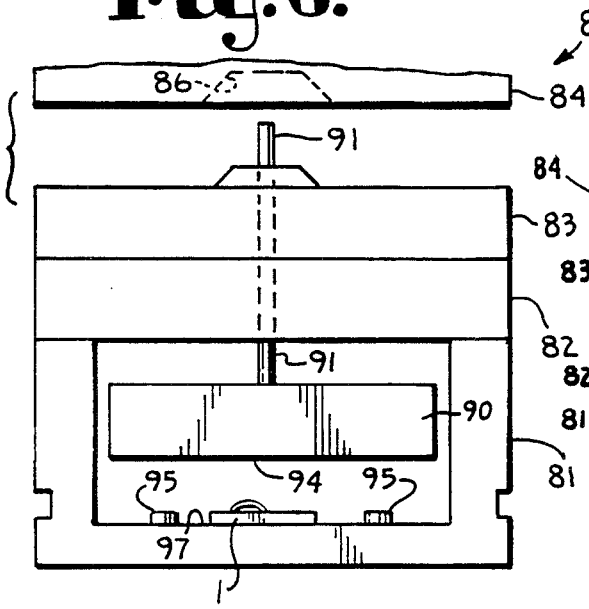
FIG. 6 is a view similar to FIG. 5 showing the ejector plate advanced out of engaging relation with the actuating mechanism.
Figure 5:
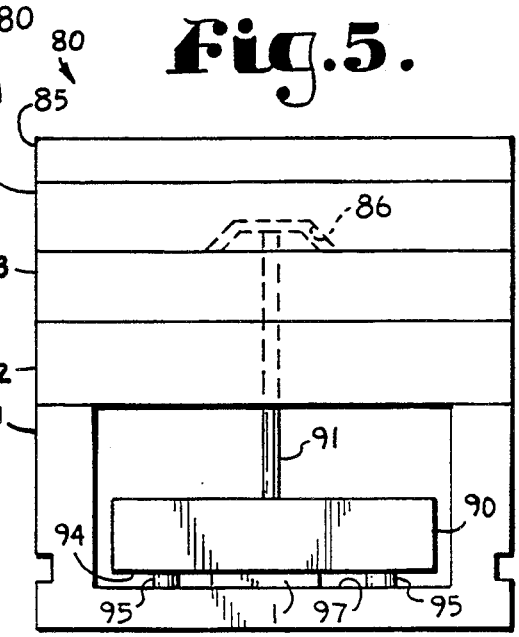
FIG. 5 is a side view of a mold base showing a limit switch actuating mechanism of the present invention secured within the mold base and showing an ejector plate advanced into engaging relation with the actuating mechanism and showing interior detail of the mold base in phantom lines.

FIGS. 5 and 6 show one use of the actuating mechanism 1 of the present invention in an injection molding application. The reference numeral 80 refers to a mold base shown in simplified form in FIGS. 5 and 6. The mold base 80 includes an ejector housing 81, a first support plate 82, a first mold plate 83, a second mold plate 84, and a second support plate 85. The first mold plate 83 is secured to the first support plate 82 which is secured to the ejector housing 81. The second mold plate 84 is secured to the second support plate 85. A mold cavity 86 is formed between the first and second mold plates 83 and 84. An ejector plate 90 having at least one ejector pin 91 secured thereto is secured within the ejector housing 81 such that the ejector pin 91 extends into the first support plate 82 and the first mold plate 83 through an opening not shown. The ejector plate 90 is advanceable between an ejecting position and a retracted position by means not shown. In the retracted position, a lower surface 94 of the ejector plate 90 engages rest buttons 95 positioned on and extending slightly above an inner surface 97 of the ejector housing 81.

When plastic is to be injected into the mold cavity 86, the ejector plate 90 is positioned in the retracted position and a distal end of the ejector pin 91 is positioned so as to be flush with an edge of the mold cavity 86. After the plastic is injected into the mold cavity 86, the first and second mold plates 83 and 84 are separated, as shown in FIG. 6, and the ejector plate 90 is advanced to the ejecting position such that the ejector pin 91 engages the molded plastic and ejects it from the mold cavity 86. The ejector plate 90 is then advanced back to a retracted position such that the ejector plate 90 engages the rest buttons 95 and the ejector pin 91 is advanced out of the mold cavity 86 such that the distal end of the ejector pin 91 is again flush with an edge of the mold cavity 86.

Prior to injection of plastic into the mold cavity 86, it is important to verify that the ejector plate 90 has returned to the retracted position and the ejector pin 91 is removed from the mold cavity 86. Previously, limit switches have been used which are positioned outside of the mold base 80 with a portion of the actuating mechanism of the limit switch extending into the ejector housing 81 so as to be activated when the ejector plate 90 returns to the retracted position. The limit switches positioned outside of the mold base 80 are exposed and subjected to bumping and damage.

Due to its relatively narrow profile, the limit switch actuating mechanism 1 of the present invention may be secured within the ejector housing 90 by bolting the actuating mechanism 1 to the inner surface 97 thereof. The actuating mechanism 1 is sized! such that the upper surface 21 of the housing 20 is generally flush with the upper surfaces of the rest buttons 95 and the middle portion 53 of the spring 50, when not engaged, extends above the upper surface 21 of the housing 20 and the upper surfaces of the rest buttons 95. As the ejection plate 90 is advanced to a retracted position, the lower surface 94 of the ejector plate 90 engages and compresses the spring 50, advancing the first spring end 51 toward the switch 50, moving the plunger 3 to the retracted position so as to change the condition of the switch 50 from an open condition to a closed condition or vice versa and send a signal indicating that the ejector plate 90 has returned to the retracted position thereby verifying that the ejector pin 91 has been removed from the mold cavity 86.

It is foreseen that the actuating mechanism 1 of the present invention has numerous applications beyond the injection molding application discussed above and its use is not intended to be limited to such applications.

It is also foreseen that the spring 50 could be sized and positioned in the slot 30 such that in the resting state the first spring end 51 holds the plunger 3 in the retracted position and the application of a force to the middle portion 53 of the spring 50 to cause the spring to bow advances the first spring end 51 away from the switch 2 a distance sufficient to allow the plunger 3 to move to the extended position. Release of the force, then allows the spring 50 to advance back to the resting position so as to allow the first spring end 51 to advance toward the switch 2 thereby moving the plunger 3 to the retracted position.

It is also foreseeable that the feet 59 and 60 may be formed by alternative means or structure than as shown in FIGS. 3 and 4. For example, it is foreseeable that the feet 59 and 60 might take the form of plastic caps securable to the first spring end 51 and the second spring end 52. The cap would present a surface for engaging the plunger 3 and a surface for engaging the backing 75 to permit relatively frictionless advancement of the spring ends 51 and 52 across the backing 75. The caps could be formed in various configurations including a cylindrical form extending from end to end across the width of the first and second spring ends 51 and 52.

It is to be understood that while certain forms of the present invention have been illustrated and described herein, it is not to be limited to the specific forms or arrangement of parts described and shown.

What is claimed and desired to be secured by Letters Patent is as follows:

1. An actuating mechanism for a plunger-type switch having alternative open and closed conditions and having a plunger moveable between an extended position and a retracted position whereby said switch condition is changed by the movement of the plunger; said actuating mechanism comprising:

(a) a housing having an upper surface; said housing being adapted to receive a plunger-type switch; and (b) a spring having a first spring end, a second spring end and a middle portion; said spring being positioned within said housing such that said first spring end is positioned in closely spaced relation to the plunger of a plunger-type switch received within said housing with the plunger in the extended position; said middle portion of said spring bowing above said housing upper surface such that the application of a force to said middle portion of said spring and directed toward said housing upper surface compresses said spring, advancing said first spring end toward the switch received within said housing a distance sufficient to move the switch plunger to the retracted position and upon removal of the force said first spring end advances away from the switch a distance sufficient to allow the switch plunger to move to the extended position.

2. The actuating mechanism as disclosed in claim 1 wherein:

(a) said first spring end is bent to form an elbow and a plunger engaging surface, said plunger engaging surface being positioned in closely spaced relation to the plunger in the extended position of a plunger type switch received within said housing.

3. The actuating mechanism as disclosed in claim 1 in combination with a plunger type switch having alternative open and close conditions and having a plunger movable between an extended position and a retracted position whereby said switch condition is change by the movement of said plunger.

4. The actuating mechanism as disclosed in claim 3 further comprising:

(a) a backing secured to and extending at least partially across a lower surface of said housing to cover said spring and said switch.

5.The actuating mechanism as disclosed in claim 3 wherein:

(a) a cavity is formed in said housing for receiving said switch; and (b) a channel extends into the housing from a lower surface thereof for receiving electrical wiring connectable to terminals on said switch; said channel extending from said cavity to a side of said housing.

6. The actuating mechanism as disclosed in claim 5 further comprising:

(a) a backing secured to and extending at least partially across said housing lower surface to cover said spring, said switch and said wiring.

7. An actuating mechanism for a plunger-type switch having alternative open and closed conditions and having a plunger moveable between an extended position and a retracted position whereby said switch condition is changed by the movement of the plunger; said actuating mechanism comprising:

(a) a housing having an upper surface a lower surface, a switch receiving cavity formed therein and a slot extending therethrough; said switch receiving cavity formed adjacent a first end of said slot and sized to receive a plunger type switch whereby a switch received in the switch receiving cavity is positioned generally adjacent a first end of said slot such that the switch plunger in the extended position extends into said slot when the plunger is in the extended position; and (b) a spring having a first spring end, a second spring end and a middle portion; said spring being positioned within said slot such that said first spring end is positioned in closely spaced relation to the switch receiving cavity whereby said first spring end is positioned in closely spaced relation to the switch plunger of a plunger-type switch received within said switch receiving cavity when the plunger is in the extended position; said middle portion of said spring bows above said housing upper surface and said second spring end engages said housing at a second end of said slot; said spring being compressible through the application of a force to said middle portion of said spring and directed toward said housing upper surface to advance said first spring end toward said switch receiving cavity and upon removal of the force said first spring end advances away from said switch receiving cavity whereby advancement of said first spring and toward said switch receiving cavity advances the plunger of a plunger type switch received within said switch receiving cavity to the retracted position and advancement of said first spring and away from said switch receiving cavity allows the switch plunger to move to said extended position.

8. The actuating mechanism as disclosed in claim 7 wherein:

(a) said first spring end is bent to form an elbow and a plunger engaging surface, said plunger engaging surface being positioned in closely spaced relation to the plunger in the extended position of a plunger type switch received within said housing.

9. The actuating mechanism as disclosed in Claim 7 in combination with a plunger type switch having alternative open and close conditions and having a plunger movable between an extended position and a retracted position whereby said switch condition is change by the movement of said plunger.

10. The actuating mechanism as disclosed in claim 9 further comprising:

(a) a backing secured to and extending at least partially across said housing lower surface to cover said spring and said switch.

11. The actuating mechanism as disclosed in claim 9 wherein:

a channel extends into the housing from a lower surface thereof for receiving electrical wiring connectable to terminals on said switch; said channel extending from said cavity to a side of said housing.

12. The actuating mechanism as disclosed in claim 11 further comprising:

(a) a backing secured to and extending at least partially across said housing lower surface to cover said spring, said switch and said wiring.

* * * * *